US008749388B2

(12) United States Patent
Hand et al.

(10) Patent No.: US 8,749,388 B2
(45) **Date of Patent: *Jun. 10, 2014**

(54) SYSTEM AND METHOD FOR SAFEGUARDING WAFERS AND PHOTOMASKS

(71) Applicant: International Business Machines Corporation, Armonk, NY (US)

(72) Inventors: Paul D. Hand, Wurtsboro, NY (US); George M. Harmuth, Hopewell Junction, NY (US); Gary T. Leonardi, Yorktown Heights, NY (US); Glenn M. Stefanski, Hopewell Junction, NY (US); Andrew P. Wyskida, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/655,842

(22) Filed: Oct. 19, 2012

(65) Prior Publication Data

US 2013/0038451 A1 Feb. 14, 2013

Related U.S. Application Data

(63) Continuation of application No. 12/465,684, filed on May 14, 2009, now Pat. No. 8,299,926.

(51) Int. Cl.
*G08B 13/14* (2006.01)

(52) U.S. Cl.
USPC ..... 340/572.1; 62/45.1; 206/701; 229/117.3

(58) Field of Classification Search
USPC ..... 340/572.1–572.9; 62/45.1; 206/701, 206/710–712; 229/117.3
See application file for complete search history.

(56) References Cited

U.S. PATENT DOCUMENTS

| | | | | |
|---|---|---|---|---|
| 7,299,603 | B2 * | 11/2007 | Horng et al. | 53/432 |
| 7,385,507 | B2 * | 6/2008 | Simpson et al. | 340/568.1 |
| 7,391,311 | B2 * | 6/2008 | Haskew | 340/467 |
| 7,608,812 | B2 * | 10/2009 | Beinhocker | 250/227.14 |
| 7,864,980 | B2 * | 1/2011 | Evans | 382/103 |
| 2004/0201454 | A1 * | 10/2004 | Waterhouse et al. | 340/10.1 |
| 2008/0093463 | A1 | 4/2008 | Chang et al. | |

* cited by examiner

*Primary Examiner* — George Bugg
*Assistant Examiner* — Edny Labbees
(74) *Attorney, Agent, or Firm* — Parashos Kalaitzis; Michael A. Petrocelli

(57) ABSTRACT

A system and a method for safeguarding wafers and photomasks. The system includes a container for storing an article, the article being a wafer or a photomask; a flashing unit for flashing light with a pre-determined light pattern; an anti-theft unit capable of performing an anti-theft function, the anti-theft unit being attached to the container; and a trigger unit electrically connected to the anti-theft unit for triggering the anti-theft function of the anti-theft unit, in response to detecting the pre-determined light pattern of the flashing unit. The method includes providing a container having an anti-theft unit capable of performing an anti-theft function; storing an article in the container, the article being a wafer or a photomask; providing a flashing light with a pre-determined light pattern; detecting the pre-determined light pattern; and performing the anti-theft function by the anti-theft unit, in response to detecting the pre-determined light pattern.

20 Claims, 4 Drawing Sheets

SYSTEM AND METHOD FOR SAFEGUARDING WAFERS AND PHOTOMASKS

CROSS-REFERENCE TO RELATED APPLICATION

This application, under 35 U.S.C. §120, is a Continuation of and claims priority from parent application U.S. patent application Ser. No. 12/465,684 filed May 14, 2009, the entire contents of which are incorporated herein by reference.

FIELD OF THE INVENTION

This invention relates generally to systems and methods for preventing loss of articles in a semiconductor manufacturing environment and in particular to a system and a method for safeguarding wafers and photomasks.

BACKGROUND OF THE INVENTION

A semiconductor manufacturing facility often uses non-descriptive containers, some of which are known as, for example, Front Opening Unified Pods (FOUPs) and Reticle Standard Mechanical InterFace Pods (RSPs) to store and transport wafers and photomasks throughout the manufacturing facility. FOUPs and RSPs provide mini environments with controlled airflow, pressure and particle counts for wafers and photomasks stored therein and thus isolate them from potential contamination. Wafers and photomasks stored in FOUPs and RSPs can be accessed by automated mechanical interfaces from production equipment, allowing them to be removed for processing or measurement without being exposed to the surrounding airflow.

FOUPs are typically used to store and transport 300 mm wafers. A FOUP has fins to hold the wafers in place and can load up to 25 wafers. Its front side is the opening door which allows robot handling mechanisms to directly access the wafers stored in the FOUP. On the other hand, RSPs are typically used for photomasks. Photomasks are also called reticles. They are typically transparent fused silica plates with a pattern defined with a chrome metal absorbing film. A photomask may also contain a pellicle to protect it from particle contamination. A pellicle is a thin transparent film stretched over a frame that is glued over one side of the photomask. A RSP has a bottom opening door which is lowered into the tool when the RSP is placed on a load port so that the photomask can be removed by the tool.

By design, the contents of FOUPs and RSPs cannot be determined by a casual visual examination. In addition, the contents of each FOUP or RSP may change multiple times during the manufacturing process. To keep track of the contents of each container, FOUPs and RSPs are often equipped with radio frequency identification (RFID) tags. A RFID tag normally has an unique identifier which is read by readers on tools and at various points in the production line. Information regarding the contents of each FOUP or RSP is stored in a relational database. The information is updated whenever the contents of a FOUP or RSP are changed. Thus, based on the unique RFID identifier associated with the RFID tag on each container and the information in the relational database, the production line can track the locations of the contents stored in each container.

FOUPs and RSPs routinely leave the manufacturing facility for additional processing or handling. Since all containers look alike and the contents of each container are not readily distinguishable, a container leaving the manufacturing facility may have unauthorized material in it. To prevent the unauthorized material from leaving the manufacturing facility, it is desired to have a system which can dynamically signal an unauthorized move of wafers and photomasks, and can destroy them if necessary.

SUMMARY OF THE INVENTION

The present invention provides a system and a method for safeguarding wafers and photomasks which is disclosed in the several embodiments following.

A first embodiment introduces a system for safeguarding an article. The system includes a container for storing the article, wherein the article is a wafer or a photomask; a flashing unit for flashing light with a pre-determined light pattern; an anti-theft unit capable of performing an anti-theft function, the anti-theft unit being attached to the container; and a trigger unit electrically connected to the anti-theft unit for triggering the anti-theft function of the anti-theft unit, in response to detecting the pre-determined light pattern of the flashing unit.

A second embodiment introduces a method for safeguarding an article. The method includes the steps of providing a container having an anti-theft unit capable of performing an anti-theft function; storing the article in the container, wherein the article is a wafer or a photomask; providing a flashing light with a pre-determined light pattern; detecting the pre-determined light pattern; and performing the anti-theft function by the anti-theft unit, in response to detecting the pre-determined light pattern.

A third embodiment introduces a method for safeguarding an article. The method includes the steps of providing a container having a first anti-theft unit capable of performing a first anti-theft function and a second anti-theft unit capable of performing a second anti-theft function; storing the article in the container, wherein the article is a wafer or a photomask; providing a first flashing light with a first pre-determined light pattern; detecting the first pre-determined light pattern; performing the first anti-theft function by the first anti-theft unit, in response to detecting the first pre-determined light pattern; providing a second flashing light with a second pre-determined light pattern, wherein the second flashing light is provided when the first anti-theft function has lasted for a period ranging from about 2 minutes to about 5 minutes after the first anti-theft function is triggered; detecting the second pre-determined light pattern; and performing the second anti-theft function by the second anti-theft unit, in response to detecting the second pre-determined light pattern.

The above described and other features are exemplified by the following figures and detailed description.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF PREFERRED EMBODIMENTS

Figure 1:
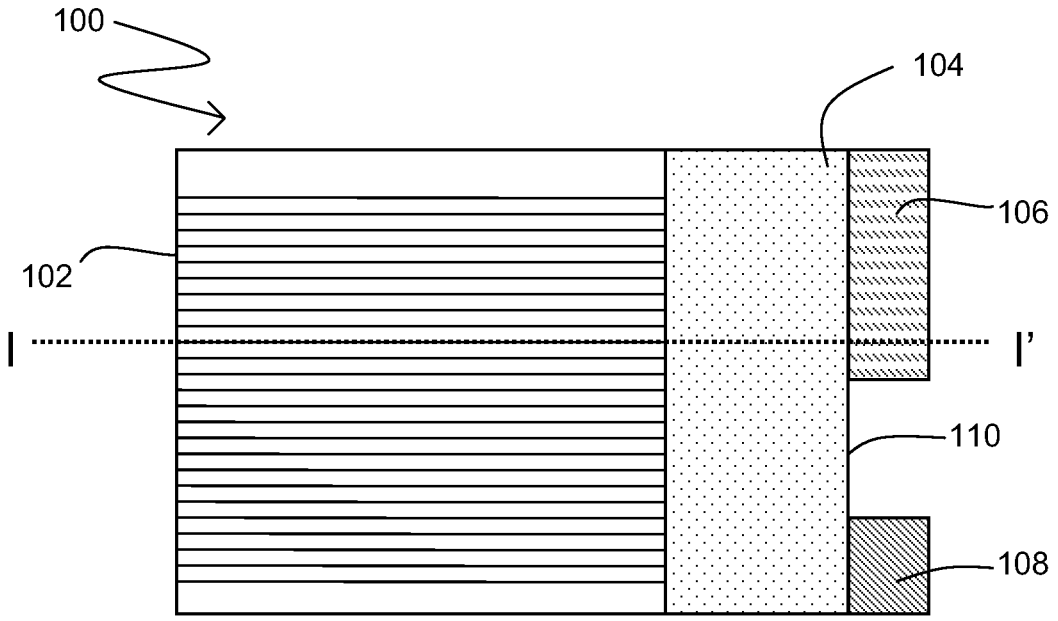
FIG. 1 is a side perspective view of a system for safeguarding a wafer, in accordance with the present invention.

The present invention will now be described more fully hereinafter with reference to the accompanying drawings in which preferred embodiments of the invention are shown. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numerals refer to like features throughout. Features of the invention are not necessarily shown to scale in the drawings.

The present invention provides a system for safeguarding an article at a semiconductor manufacturing facility. The article is preferably a wafer or a photomask. The system includes a container for storing the wafer or the photomask; a flashing unit for flashing light with a pre-determined light pattern; an anti-theft unit capable of performing an anti-theft function, the anti-theft unit being attached to the container; and a trigger unit electrically connected to the anti-theft unit for triggering the anti-theft function of the anti-theft unit, in response to detecting the pre-determined light pattern of the flashing unit.

The container may be any containers used to store and transport wafers and photomasks throughout a semiconductor manufacturing facility. Suitable containers for the present invention include, but are not limited to, FOUPs, SMIF Pods, and RSPs. A FOUP is generally used to store and transport 300 mm wafers. A SMIF Pod is typically for smaller wafers such as wafers with a diameter of 200 mm or less. A RSP is to store and transport photomasks used in photolithography.

The flashing unit is a unit which flashes light with a pre-determined light pattern. In one preferred embodiment, the flashing unit is a radio frequency identification (RFID) tag having a light-emitting diode (LED) light. The RFID tag may be any RFID tags commonly used with FOUPs and RSPs. Each RFID tag has an unique identifier. Preferably, the RFID tag is attached to the container. A computer system may be used to communicate and control the RFID tag. Information regarding the contents of the container is stored in the computer system and is updated whenever the content of the container is changed. Based on the unique RFID identifier of the RFID tag on the container and the content information, the computer system can track the locations of the contents stored in the container. The computer system is programmed in a way such that when a container with a specific content travels to a location where such a content is prohibited, for example, an exit at the manufacturing facility, the computer system will automatically trigger the LED light of the RFID tag to flash light with a pre-determined light pattern.

In another preferred embodiment, the flashing unit is a flashing light installed at an exit of a semiconductor manufacturing facility. In this case, the flashing light flashes with a pre-determined light pattern constantly. Once the container moves close to the exit, the light pattern of the flashing light will be detected by the trigger unit on the container.

The pre-determined light pattern of the flashing unit may be a coded digital series of light flashes, similar to the coded signal in a TV remote. For example, a coded digital light flash may have light pulses and gaps. Each of the light pulses and the light gaps is 10 milliseconds long. A logical 1 represents a 10-millisecond light pulse and a logical 0 is a gap of no light for the same length of time. A light pattern with a first 10-millisecond light pulse, then 60 milliseconds of gaps of no light, followed by a second 10-millisecond light pulse has a coded digital signal of 10000001. Similarly, a light pattern with a first 10-millisecond light pulse, then 50 milliseconds of gaps of no light, followed by a second and a third 10-millisecond light pulses has a coded digital of 10000011. Each anti-theft unit is assigned with a particular light pattern. The trigger unit is programmed to recognize the light patterns and to trigger the corresponding anti-theft units to perform their anti-theft functions based on the light patterns received.

The anti-theft unit is any device which can give an alarm or destroy the contents stored in the container when an unauthorized move of the container is detected. Examples of suitable anti-theft devices include, but are not limited to, a strobe light, a sound alarm, an airbag, a discharging device, or a combination comprising two or more of the foregoing devices. Preferably, the anti-theft unit is attached to the container.

The airbag is similar in technology to a car airbag system. It includes a solid propellant inflator and a nylon bag. The airbag is installed along the back wall of the FOUP. The solid propellant inflator contains solid chemicals such as sodium azide ($NaN_3$) and potassium nitrate ($KNO_3$). If triggered, sodium azide and potassium nitrate react with each and generate nitrogen ($N_2$) gas. The nitrogen gas generated then rapidly expands the nylon bag, forcing the bag into contact with the wafers stored in the FOUP and breaking them. Any excess nitrogen gas is vented out though the normal venting system built into each FOUP.

The discharging device is a device electrically connected to a photomask stored in the container and is capable of discharging an electric current on the photomask. The discharging of the electric current is similar to a Tazzer charge. The electric current operates to destroy the metal pattern on the photomask.

The anti-theft function is a function to render an alarm or to destroy the contents stored in the container. Each anti-theft unit is capable of performing an anti-theft function. For example, the strobe light and the sound alarm, if triggered, can flash the light and sound the alarm respectively. The airbag can inflate so as to break at least one wafer in the container. The anti-theft function of the discharging device is to discharge a current on the photomask stored in the container, thereby destroy a metal pattern on the photomask.

The trigger unit includes a photo-transistor, a microprocessor, and a battery. The trigger unit is electrically connected to the at least one anti-theft unit. Once the photo-transistor detects the pre-determined light pattern of the flashing unit, it relays the light pattern information to the microprocessor. Based on the coded digital signal the microprocessor receives, the microprocessor selectively triggers the corresponding anti-theft unit to perform its anti-theft function. Preferably, the trigger unit is mounted on the container.

When the container is a FOUP for storing wafers, the anti-theft unit is preferably an airbag. FIG. 1 is a side perspective view of a system for safeguarding a wafer, in accordance with the present invention. The system comprises a FOUP 100 installed with a RFID tag 108 having a LED light, an airbag 104 and a trigger unit 106. FOUP 100 is a conventional FOUP used for 300 mm wafers. It has 25 shelves for holding up to 25 wafers. FOUP 100 has a front opening door 102 which allows robot handling mechanisms to directly access wafers from FOUP 100 and a back wall 110. RFID tag 108 and trigger unit 106 are mounted on the outside of the back wall 110. Trigger unit 106 is preferably mounted in an area reserved for attachments on FOUP 100. Airbag 104 is placed along the back wall 110 inside FOUP 100. Airbag 104 includes a solid propellant inflator and a nylon bag.

Figure 2:
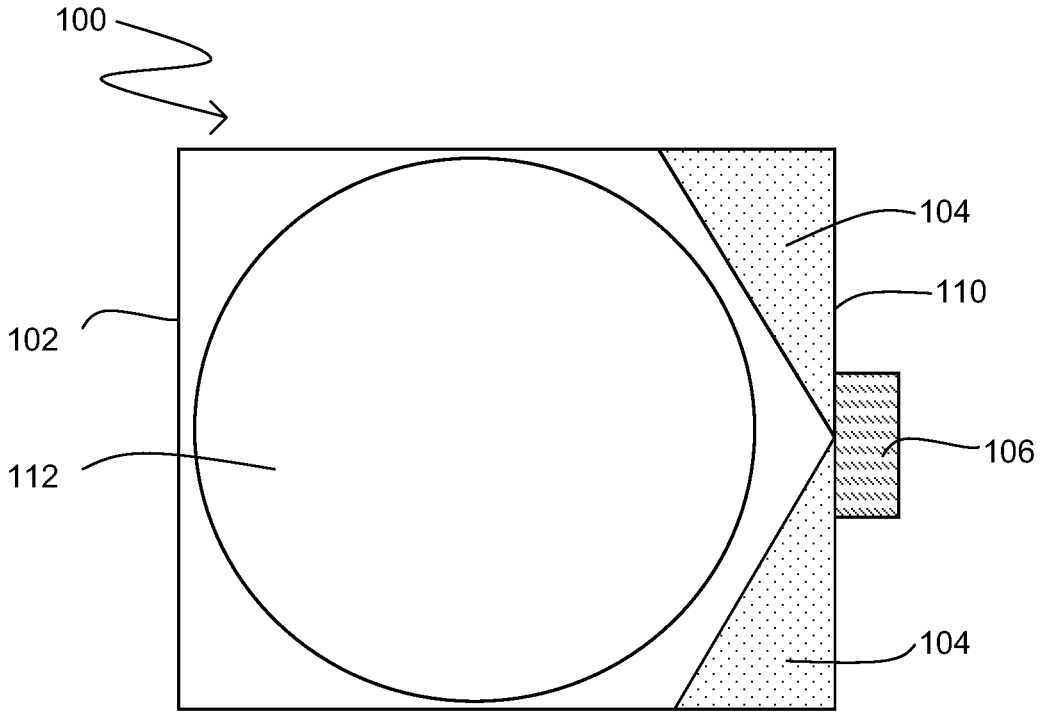
FIG. 2 is a schematic cross sectional view of the system taken along the line I-I' of FIG. 1.

FIG. 2 is a schematic cross sectional view of the system taken along the line I-I' of FIG. 1. When trigger unit 106 detects a pre-determined light pattern from the LED light of RFID tag 108, it releases a small electrical charge to ignite the solid propellant inflator in airbag 104. The solid chemicals inside the solid propellant inflator react and form nitrogen gas. The nitrogen gas rapidly expands the nylon bag of airbag 104, forcing it into contact with wafer 112 and to break wafer 112.

Figure 3:
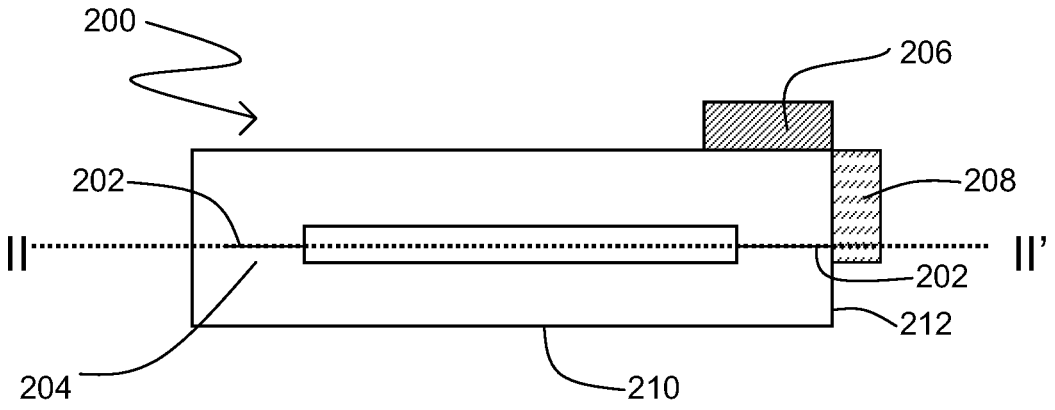
FIG. 3 is a side perspective view of a system for safeguarding a photomask, in accordance with the present invention.

When the container is a RSP for storing photomasks, the anti-theft unit is preferably a discharging device. FIG. 3 is a side perspective view of a system for safeguarding a photomask, in accordance with the present invention. The system comprises a RSP 200 equipped with a RFID tag 206 having a LED light and a trigger unit 208. RSP 200 is a typical RSP used for photomasks. It has a bottom opening door 210 which is lowered into a tool when RSP 200 is placed on a load port so that the photomask stored in it can be removed by the tool. RFID tag 206 is mounted on top of RSP 200. Trigger unit 208 is mounted on the outside of the back wall 212. Trigger unit 208 is electrically connected to photomask 204 stored in RSP 200 through wire 202. In this case, trigger unit 208 is also the discharging device.

Figure 4:
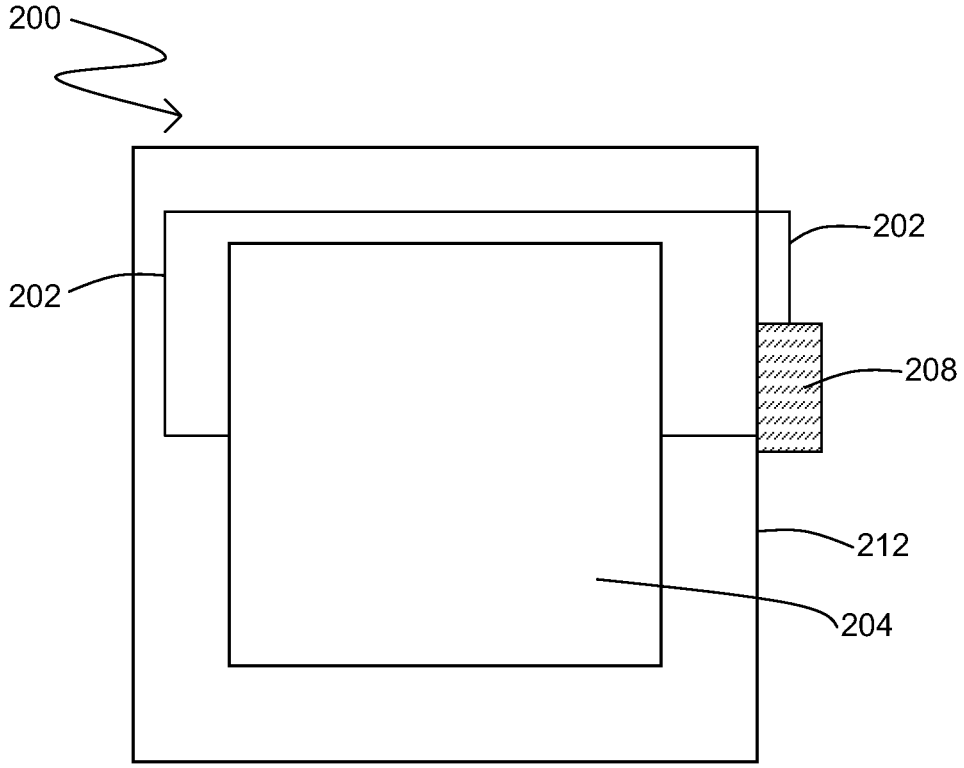
FIG. 4 is a schematic cross sectional view of the system taken along the line II-II' of FIG. 3.

FIG. 4 is a schematic cross sectional view of the system taken along the line II-II' of FIG. 3. When trigger unit 208 detects a pre-determined light pattern from the LED light of RFID tag 206, it discharges an electrical current through wire 202 to the surface of photomask 204. The metal patterns on photomask 204 are vaporized by the current and photomask 204 is rendered useless.

Figure 5:
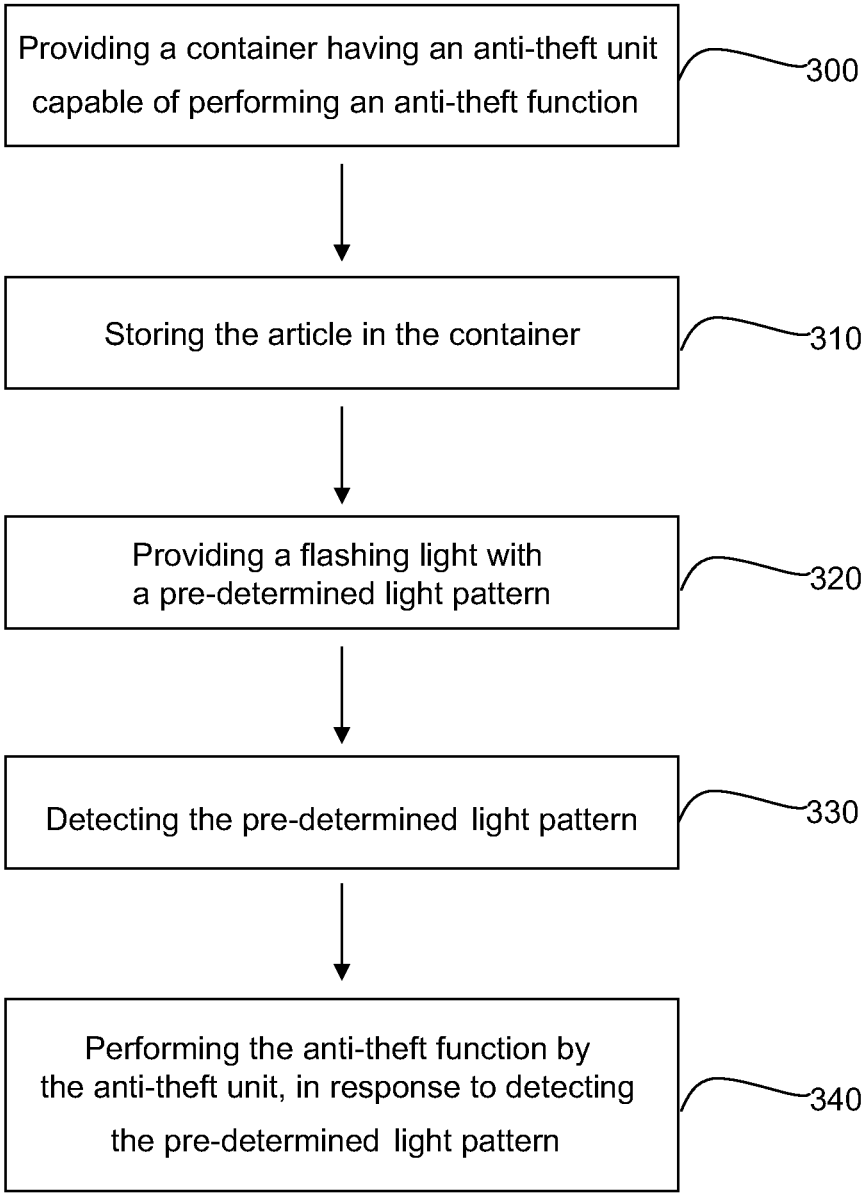
FIG. 5 is a flow chart illustrating a method for safeguarding an article, in accordance with an embodiment of the present invention.

Referring now to the flow chart of FIG. 5, a method aspect of the present invention is described. Step 300 comprises providing a container having an anti-theft unit capable of performing an anti-theft function. Examples of suitable containers include, but are not limited to, a FOUP and a RSP. Examples of suitable anti-theft units include, but are not limited to, a strobe light, a sound alarm, an airbag, a discharging device, and a combination comprising two or more of the foregoing devices, as discussed above.

In Step 310 an article is stored in the container. The article is preferably a wafer or a photomask.

Step 320 comprises providing a flashing light with a pre-determined light pattern. In one preferred embodiment, the flashing light is provided by a RFID system. The RFID system includes a RFID tag having a LED light and a computer system which controls the RFID tag. The computer system sends a signal to the RFID tag. Once the signal is received, the RFID tag flashes the LED light with a pre-determined light pattern. Preferably, the RFID tag is attached to the container. In another preferred embodiment, Step 310 includes providing a flashing light with a pre-determined light pattern at an exit of a semiconductor manufacturing facility. The pre-determined light pattern may be a coded digital series of light flashes.

Step 330 comprises detecting the pre-determined light pattern. Preferably, the detection of the pre-determined light pattern is performed by a trigger unit electrically connected to the anti-theft unit. The trigger unit may include a phototransistor, a microprocessor, and a battery. The trigger unit is programmed to recognize the pre-determined light pattern and to trigger a specific anti-theft unit to perform its anti-theft function based on the light pattern received.

Step 340 comprises performing the anti-theft function by the anti-theft unit, in response to detecting the pre-determined light pattern. Step 340 may include flashing the strobe light, sounding the sound alarm, inflating the airbag so as to break the wafer stored in the container, or discharging a current on the photomask with the discharging device so as to destroy a metal pattern on the photomask.

Figure 6:
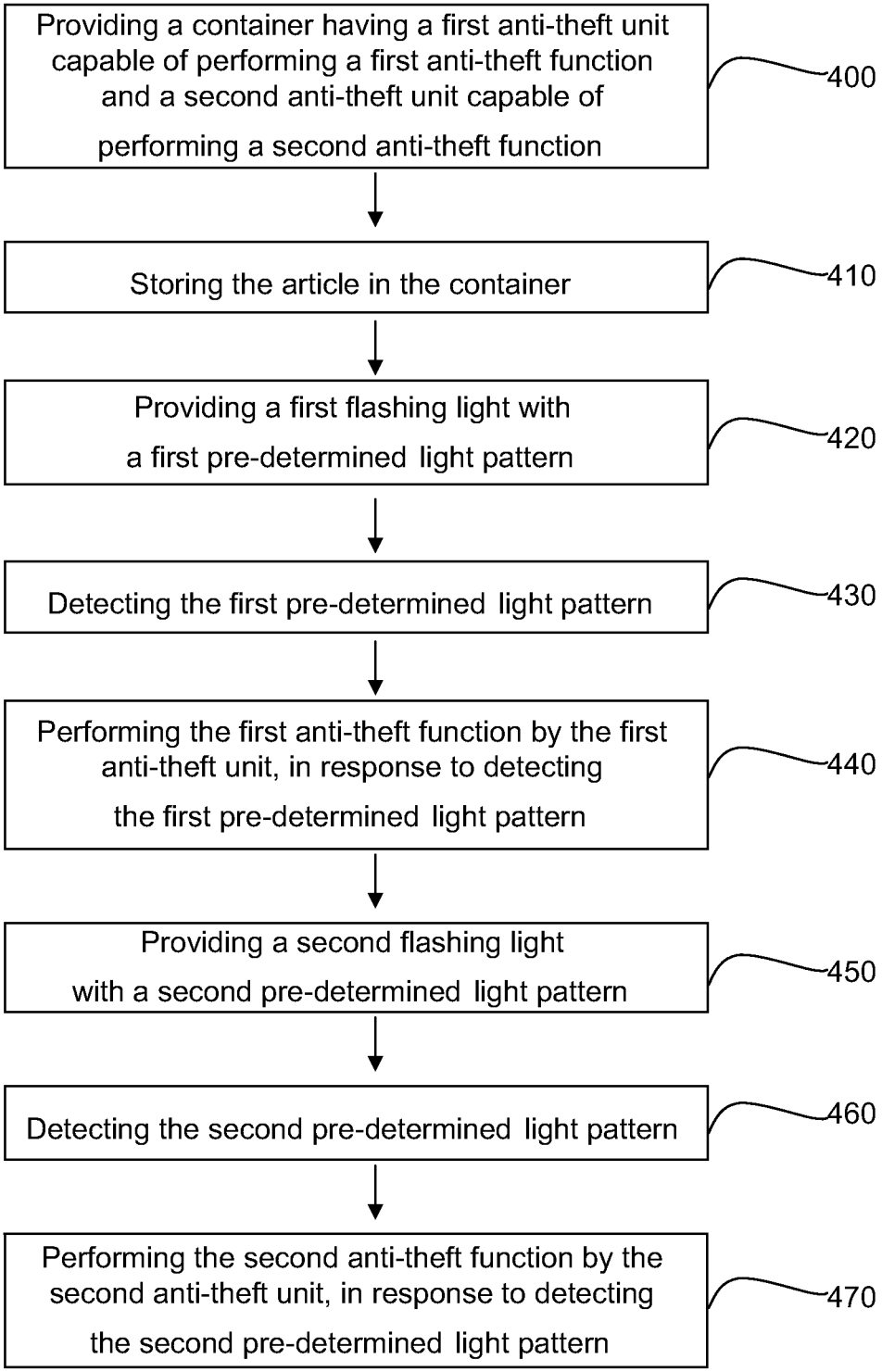
FIG. 6 is a flow chart illustrating a method for safeguarding an article, in accordance with another embodiment of the present invention.

FIG. 6 is a flow chart illustrating a method for safeguarding an article, in accordance with another embodiment of the present invention. Step 400 comprises providing a container having a first anti-theft unit capable of performing a first anti-theft function and a second anti-theft unit capable of performing a second anti-theft function. Examples of suitable containers include, but are not limited to, a FOUP and a RSP. Examples of suitable first anti-theft units include, but are not limited to, a strobe light and a sound alarm. Examples of suitable second anti-theft units include, but are not limited to, an airbag and a discharging device. The airbag may further include a solid propellant inflator and a nylon bag. The discharging device is electrically connected to an article stored in the container, such as a photomask.

In Step 410 the article is stored in the container. The article is preferably a wafer or a photomask.

Step 420 comprises providing a first flashing light with a first pre-determined light pattern, such as described in Step 320 above. The first flash light may be performed by a RFID system or a flashing light at an exit of a semiconductor manufacturing facility. The RFID system includes a RFID tag having a LED light and a computer system for controlling the RFID tag.

Step 430 comprises detecting the first pre-determined light pattern, such as described in Step 330 above. Step 420 may include detecting the light pattern with a first trigger unit electrically connected to the first anti-theft unit.

Step 440 comprises performing the first anti-theft function by the first anti-theft unit in response to detecting the first pre-determined light pattern, such as described in Step 340 above. The first anti-theft function is preferably a mild anti-theft function such as flashing a strobe light or sounding a sound alarm. The first anti-theft function acts to give a warning that an unauthorized move of wafers or photomasks is detected.

Step 450 comprises providing a second flashing light with a second pre-determined light pattern. As described in Step 420 above, the second flash light may be performed by a RFID system or a flashing light at an exit of a semiconductor manufacturing facility. It is preferred that the second flashing light is provided when the first anti-theft function has lasted for a time period after it is triggered and is not de-activated. The time period is preferably from about 2 minutes to about 5 minutes. If the first anti-theft function is de-activated within the time period, the second flashing light will not flash with the second pre-determined light pattern. Consequently, the second anti-theft function will not be performed by the second anti-theft unit.

Step 460 comprises detecting the second pre-determined light pattern, such as described in Step 430 above. Step 460 may include detecting the light pattern with a second trigger unit connected to the second anti-theft unit.

Step 470 comprises performing the second anti-theft function by the second anti-theft unit, in response to detecting the second pre-determined light pattern. Preferably, the second anti-theft function is harsher than the first anti-theft function. More preferably, the second anti-theft function includes a function which can destroy the contents stored in the container. Suitable anti-theft functions include, but are not limited to, inflating an airbag so as to break the wafer in the container or discharging a current on the photomask with a discharging device so as to destroy a metal pattern on the photomask.

The first and the second pre-determined light patterns are preferably coded digital series of light flashes. The second pre-determined light pattern may have a different pattern from the first pre-determined light pattern. The first and the second trigger units may be the same unit or different units.

While the present invention has been particularly shown and described with respect to preferred embodiments, it will be understood by those skilled in the art that the foregoing and other changes in forms and details may be made without departing from the spirit and scope of the invention. It is therefore intended that the present invention not be limited to the exact forms and details described and illustrated but fall within the scope of the appended claims.

What is claimed is:

1. A system for safeguarding an article comprising:

a container for storing the article, wherein the article is a wafer or a photomask;

a flashing unit for flashing light with a pre-determined light pattern;

an anti-theft unit capable of performing an anti-theft function, the anti-theft unit being attached to the container; and a trigger unit electrically connected to the anti-theft unit for triggering the anti-theft function of the anti-theft unit, in response to detecting the pre-determined light pattern of the flashing unit, wherein the antitheft function comprises at least one of: i) breaking the wafer by inflation of an airbag and ii) destroying a metal pattern of the photomask by discharging electrical current on the photomask.

2. The system of claim 1, wherein the container is a Front Opening Unified Pod (FOUP) or a Reticle Standard Mechanical InterFace Pod (RSP).

3. The system of claim 1, wherein the flashing unit is a radio frequency identification (RFID) tag having a light-emitting diode (LED) light, the RFID tag being attached to the container.

4. The system of claim 3 further comprising a computer system for controlling the RFID tag.

5. The system of claim 1, wherein the flashing unit is a flashing light installed at an exit of a semiconductor manufacturing facility.

6. The system of claim 1, wherein the pre-determined light pattern comprises a coded digital series of light flashes.

7. The system of claim 1, wherein the anti-theft unit comprises a strobe light, a sound alarm, an airbag, or a discharging device.

8. The system of claim 7, wherein the container is a FOUP and the anti-theft unit is an airbag comprising a solid propellant inflator and a nylon bag.

9. The system of claim 7, wherein the container is a RSP and the anti-theft unit is a discharging device electrically connected to the photomask stored in the container.

10. The system of claim 1, wherein the trigger unit comprises a photo-transistor, a microprocessor, and a battery.

11. A method for safeguarding an article comprising:

providing a container having an anti-theft unit capable of performing an anti-theft function;

storing the article in the container, wherein the article is a wafer or a photomask;

providing a flashing light with a pre-determined light pattern;

detecting the pre-determined light pattern; and performing the anti-theft function by the anti-theft unit, in response to detecting the pre-determined light pattern, wherein the antitheft function comprises one of: i) inflating an airbag to break the wafer or ii) destroying a metal pattern on the photomask by discharging an electrical current on the photomask.

12. The method of claim 11, wherein the container is a FOUP or a RSP.

13. The method of claim 11, wherein the step of providing a flashing light comprises:

sending a signal from a computer system to a RFID tag attached to the container, wherein the RFID tag has a LED light and is controlled by the computer system; and flashing the LED light with a pre-determined light pattern in response to receiving the signal from the computer system.

14. The method of claim 11, wherein the step of providing a flashing light comprises providing a flashing light with a pre-determined light pattern at an exit of a semiconductor manufacturing facility.

15. The method of claim 11, wherein the step of detecting the pre-determined light pattern comprises detecting the pre-determined light pattern with a trigger unit electrically connected to the anti-theft unit.

16. The method of claim 15, wherein the trigger unit comprises a photo-transistor, a microprocessor, and a battery.

17. The method of claim 11, wherein the anti-theft unit comprises a strobe light, a sound alarm, an airbag, or a discharging device.

18. A method for safeguarding an article comprising:

providing a container having a first anti-theft unit capable of performing a first anti-theft function and a second anti-theft unit capable of performing a second anti-theft function;

storing the article in the container, wherein the article is a wafer or a photomask;

providing a first flashing light with a first pre-determined light pattern;

detecting the first pre-determined light pattern;

performing the first anti-theft function by the first anti-theft unit, in response to detecting the first pre-determined light pattern;

providing a second flashing light with a second pre-determined light pattern, wherein the second flashing light is provided when the first anti-theft function has lasted for a period ranging from about 2 minutes to about 5 minutes after the first anti-theft function is triggered;

detecting the second pre-determined light pattern; and performing the second anti-theft function by the second anti-theft unit, in response to detecting the second pre-determined light pattern, wherein at least one of the two antitheft functions comprises destroying the photomask or the wafer.

19. The method of claim 18, wherein the step of performing the first anti-theft function comprises flashing a strobe light or sounding a sound alarm.

20. A system for safeguarding an article comprising:

a container for storing the article, wherein the article is a wafer or a photomask;

a flashing unit for flashing light with a pre-determined light pattern;

an anti-theft unit capable of performing an anti-theft function that destroys the wafer or photomask, the anti-theft unit being attached to the container; and a trigger unit electrically connected to the anti-theft unit for triggering the destroying anti-theft function of the antitheft unit, in response to detecting the pre-determined light pattern of the flashing unit.

* * * * *